United States Patent [19]

Hjortsberg

[11] Patent Number: 4,908,497

[45] Date of Patent: Mar. 13, 1990

[54] FLAT ELECTRICAL RESISTANCE HEATING ELEMENT

[75] Inventor: Bengt Hjortsberg, Hallstahammar, Sweden

[73] Assignee: Kanthal AB, Hallstahammar, Sweden

[21] Appl. No.: 316,293

[22] Filed: Feb. 27, 1989

[51] Int. Cl.[4] ..... H05B 3/10

[52] U.S. Cl. ..... 219/539; 219/548; 219/549; 219/553; 338/61

[58] Field of Search ..... 219/211, 212, 345, 528, 219/529, 539, 213, 217, 527, 530, 538, 539, 544, 545, 548, 549, 553; 338/60–63, 212; 307/89, 91

[56] References Cited

U.S. PATENT DOCUMENTS

| | | | |
|---|---|---|---|
| 1,100,708 | 6/1914 | Brooks | 338/61 |
| 1,552,686 | 9/1925 | Eversheim | 338/61 |
| 2,757,273 | 7/1956 | Taylor | 219/539 |
| 2,762,896 | 9/1956 | Pendleton | 219/539 |

*Primary Examiner*—Bruce A. Reynolds

*Assistant Examiner*—Leon K. Fuller

*Attorney, Agent, or Firm*—Cohen, Pontani & Lieberman

[57] ABSTRACT

The invention is for a flat electrical heating resistance element, so called foil elements. Elements according to the invention can be used for many purposes, however, it is specially intended for use as heating elements for water beds. The object of the invention is to minimize the electromagnetic fields caused by the elements. The influence of such magnetic fields on humans is on the whole unknown why there is a common desire that the strength of these magnetic fields shall be as low as possible in order to minimize effects, if any. Heating elements according to the invention have electrical resistance wire or band placed in loops on a plastic foil surface, whereby the loops have four with each other parallel conductors, electrically connected so that in any given moment the direction of the current in the two outer conductors are in the same direction and in the two inner conductors in the same direction opposite to the outer conductors.

5 Claims, 2 Drawing Sheets

FIG. 1
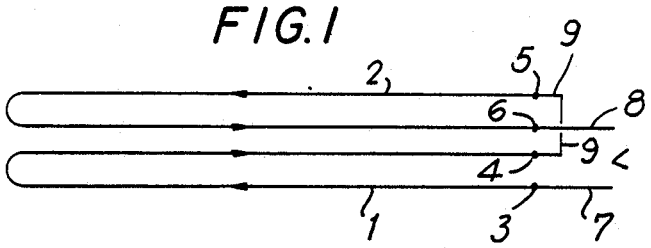
FIG. 2
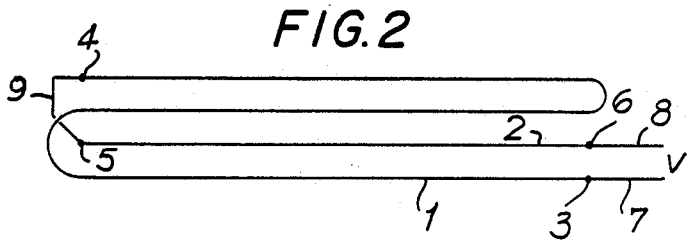
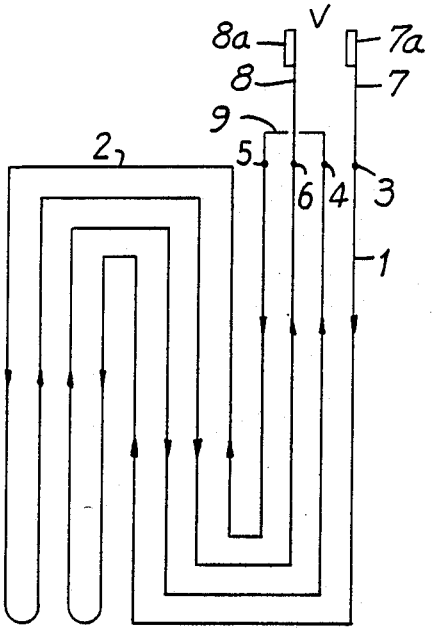
FIG. 3
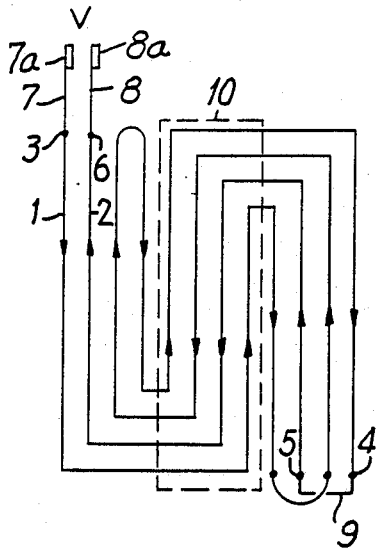
FIG. 4

FLAT ELECTRICAL RESISTANCE HEATING ELEMENT

This invention is for a flat electrical heating resistance element.

Resistance elements of the kind to which the invention refers find many different uses. Examples of such uses are heating of flat surfaces such as floors and roofs, i.e. room and space heating, heating of electrically heated blankets and mattresses, especially for medical purposes. The present invention can be used and has advantages in all these applications but it is specially intended for use as a heating element for water beds.

The resistance elements for the above mentioned purpose is suitably so called foil elements. These comprise an electrical conductor which is adhered to and/or between films of insulating material, preferably plastic film. In order to obtain the wanted properties of the elements the film may have several layers. The most commonly used plastic materials are polyester, polyethylene and PVC but for special applications high temperature resistant materials such as polyimid are used.

The electrical conductor which is embedded in the insulating pump is preferably wire or ribbon from thin metal foil. The pattern thereof can be obtained by etching of a metal foil which is laminated with a plastic film. The thickness of the metal foil can be in the order of hundreds of mm and the width of the ribbons in the so prepared pattern may vary from a few tenth of a mm up to a few mm. Suitable metalic materials are brass, aluminium and certain stainless alloys, nickel-chromium, copper-nickel and iron-chromium-aluminium-alloys. For special purposes also lead/tin-alloys are used. It is also possible that the resistance wire is a metallic wire preferably with a circular cross section which is applied to the film in a desired pattern.

Like most other electrical equipments also resistance elements cause electromagnetic fields. Such fields may have effects upon human beings but hitherto little is known about which effects these magnetic fields may have on humans. This is true at least in case of magnetic fields which vary at low frequencies and which have low strength. Electrical current for domestic use has a frequency of about 50 hertz which in this situation is to be considered a low frequency and appliances and devises which are used in households cause magnetic fields of low strength only. Since the influence of such magnetic fields on human beings on the whole is unknown there is a common desire that the strength of these magnetic fields shall be as low as possible in order to minimize effects, if any. Resistance elements of the kind considered herein also cause such magnetic fields and the invention is for resistance elements of the kind, where the strength of the magnetic fields is considerably lower than with previously known resistance elements of the corresponding kind, so-called foil elements.

The present invention is for flat electrical resistance heating elements having electrical conductors placed in loops over a surface, the conductors comprising resistance wire or ribbon, and is characterized therein, that the loops have four with each other over essentially the entire element parallel conductors and arrangements for connection of the conductors to a voltage source. The four parallel conductors are electrically so connected that in a given moment the direction of the current in the two outer conductors are in the same direction and in the two inner conductors in the same direction opposite to the outer conductors. Preferably the conductors are two by two connected in one end so that two pairs of parallel conductors are obtained. This is obtained thereby that the conductors at each end thereof have a terminal point and that one terminal point of each pair of conductors is connected to a terminal point on the other pair of conductors and one terminal point of each pair of conductors is connected to a voltage source. Preferably the two with each other connected terminal points of the two pairs of conductors are not those of two adjacent to each other positioned of the four parallel conductors. The loops formed by the four parallel conductors ought to be so placed on the surface that the conductors as far as possible are parallel to each other, whereby the distance between two conductors is essentially the same both between the four conductors and between adjacent to each other positioned conductors of adjacent loops.

Below the invention will be further described with reference to the enclosed drawings.

FIGS. 1 and 2 outline two different ways of creating elements according to the invention.

FIGS. 3 and 4 show in corresponding ways formed elements having longer conductors which have been positioned in several loops.

Figure 5:
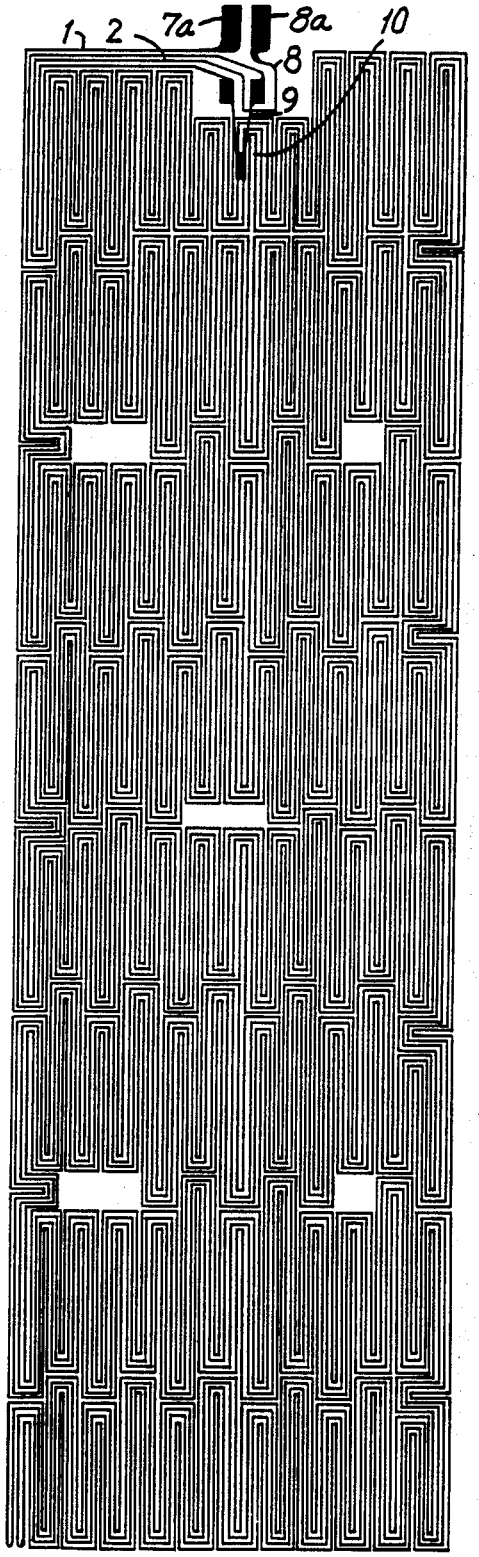
FIG. 5 shows a full scale element according to the invention.

In FIGS. 1–5 the same reference numerals have been used for the same parts. The elements comprise a number of loops and in FIG. 4 a part of such a loop has been enclosed by a dotted line 10. Each loop has four parallel and at equal distances from each other arranged conductors. These are made from two wires or ribbons 1 and 2 and in the embodiments shown in FIGS. 1 and 3 they may be said to be connected in pairs so that two pairs of conductors 1 and 2 are obtained. The conductors or pairs of conductors have terminal points 3, 4, 5 and 6. At each pair of conductors or the like one terminal point 3 and 6 is connected to a corresponding lead 7 and 8. The leads may be bands with widened portions 7A and 8A or be made in another suitable way. The two pairs of conductors are connected by the connector 9. The latter may as in the in FIG. 5 shown embodiment of the invention include the heat fuse 10.

Figure 6:
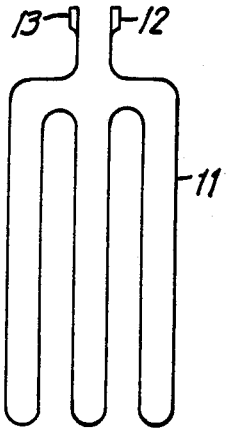
FIG. 6 shows an element according to the state of the art.

The element according to the state of the art as shown in FIG. 6 comprises a conductor 11 with two leads 12 and 13. 13.

In FIGS. 1–4 and 6 the direction of the current in a given moment has been indicated by arrows. It is then obvious that in an element according to the invention the direction of the current in the two outer conductors is one and the same and in the two inner conductors the same opposite direction. This arrangement brings with it an important decrease of the magnetic field caused by the elements. Different from elements according to the invention the direction of the current in two adjacent conductors in an element according to the state of art as shown in FIG. 6 is always opposite to each other.

The magnetic fields caused by different elements has been recorded. Recordings were made at a distance of 10 cm at right angles from the flat surface of the elements and with the elements connected to alternating current of 220 V, 50 Hz. At the time of recording the current in the elements was about 1.4 A. With elements according to the invention the magnetic field at different positions above the element was 0.10–0.15 μT. Recordings were also made under the same conditions with an element according to state of the art whereby the magnetic field was about 1.6 μT.

I claim:

1. A flat electrical heating element comprising:

a supporting surface;

a pair of electrical conductors defining a single continuous loop on said supporting surface, said loop comprising four substantially parallel and spaced apart conductor lengths comprising two relatively adjacently disposed inner lengths and two outer lengths spaced apart by said inner lengths; and means for connecting said conductors to a voltage source, said conductors are electrically connected so that the direction of current flow is the same in the outer two conductors and the direction of current flow in the inner two conductors is the same but opposite to the direction of current flow in the outer two conductors.

2. The heating element according to claim 1, wherein said conductors are two-by-two connected at one end thereof so that two pairs of parallel conductors are obtained.

3. The heating element according to claim 2, additionally comprising a terminal point at each conductor;

means for connecting the terminal points of one pair of conductors to a voltage source; and means for connecting the terminal points of the other pair of conductors to each other.

4. The heating element of claim 3, wherein the two connected terminal points of each pair of said conductors are not those of two adjacent conductors.

5. The heating element according to claim 1, wherein said loops are placed on said surface so that said conductors are parallel to each other, and the distance between said conductors is essentially the same between said four conductors and between respective conductors of adjacent loops.

* * * * *